US009312642B2

(12) United States Patent
Wang et al.

(10) Patent No.: US 9,312,642 B2
(45) **Date of Patent: *Apr. 12, 2016**

(54) CROSSTALK-PROOF RECEPTACLE CONNECTOR

(71) Applicant: Advanced-Connectek Inc., New Taipei (TW)

(72) Inventors: Yao-Te Wang, New Taipei (TW); Kuo-Ching Lee, New Taipei (TW); Ya-Ping Liang, New Taipei (TW); Jian-Li Guan, Tian-Jin (CN)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/260,695

(22) Filed: Apr. 24, 2014

(65) Prior Publication Data

US 2014/0342607 A1 Nov. 20, 2014

(30) Foreign Application Priority Data

May 17, 2013 (CN) ..... 2013 1 0182753

(51) Int. Cl.
*H01R 9/03* (2006.01)
*H01R 13/6587* (2011.01)
*H01R 13/518* (2006.01)

(52) U.S. Cl.
CPC ..... *H01R 13/6587* (2013.01); *H01R 13/518* (2013.01)

(58) Field of Classification Search
CPC ..... H01R 13/6461; H01R 12/724; H01R 13/514; H01R 13/6474
USPC ..... 439/607.05, 607.34, 95, 607.37, 439/607.35, 607.23, 607.28
See application file for complete search history.

(56) References Cited

U.S. PATENT DOCUMENTS 6,409,543 B1 * 6/2002 Astbury, Jr. ..... H01R 13/65807 439/607.07
6,743,057 B2 * 6/2004 Davis ..... H01R 23/688 439/607.05
6,986,682 B1 * 1/2006 Jeon ..... H01R 23/6873 439/607.07
7,074,086 B2 * 7/2006 Cohen ..... H01R 23/688 439/607.08
7,347,740 B2 3/2008 Minich
7,410,393 B1 * 8/2008 Rothermel ..... H01R 29/00 439/49
8,182,289 B2 * 5/2012 Stokoe ..... H01R 23/688 439/607.07
8,870,594 B2 * 10/2014 McClellan ..... H01R 9/22 439/607.05
8,894,442 B2 * 11/2014 McClellan ..... H01R 13/648 439/607.05
2004/0224559 A1 * 11/2004 Nelson ..... H01R 13/514 439/607.05
2007/0004282 A1 * 1/2007 Cohen ..... H01R 13/514 439/607.02

(Continued)

*Primary Examiner* — Abdullah Riyami
*Assistant Examiner* — Nader J Alhawamdeh

(57) ABSTRACT

A crosstalk-proof receptacle connector includes: multiple insulative boards arranged abreast; multiple sets of terminals mounted respectively in and corresponding to the insulative boards, and each set including signal terminals and grounding terminals; multiple shielding plates corresponding to the insulative boards and corresponding to the sets of the terminals, each shielding plate mounted on one of two opposite sides of a corresponding insulative board and having multiple current-path-interrupting holes defined through the shielding plate and kept hollow without being inserted by objects, and each shielding plate connected to the grounding terminals of a corresponding set of the terminals; and an outer casing covering the insulative boards to combine the insulative boards. The crosstalk-proof receptacle connector suppresses crosstalk and improves efficiency and stability of signal transmission.

16 Claims, 12 Drawing Sheets

(56) References Cited

U.S. PATENT DOCUMENTS

2007/0155241 A1* 7/2007 Lappohn ..... H01R 13/514 439/607.07
2008/0214029 A1* 9/2008 Lemke ..... H01R 13/6471 439/108
2009/0035955 A1* 2/2009 McNamara ..... H01R 13/514 439/65
2009/0093158 A1* 4/2009 McAlonis ..... H01R 13/514 439/607.41
2009/0227141 A1* 9/2009 Pan ..... H01R 23/688 439/607.03
2009/0233471 A1* 9/2009 Pan ..... H01R 13/514 439/108
2010/0197149 A1* 8/2010 Davis ..... H01R 12/727 439/59
2010/0240233 A1* 9/2010 Johnescu ..... H01R 13/514 439/108
2011/0117781 A1* 5/2011 Stoner ..... H01R 13/6587 439/607.01
2011/0189892 A1* 8/2011 Mizukami ..... H01R 13/648 439/607.34
2011/0212649 A1* 9/2011 Stokoe ..... H01R 23/688 439/626
2012/0184140 A1* 7/2012 Davis ..... H01R 12/724 439/607.34
2012/0214343 A1* 8/2012 Buck ..... H01R 13/6586 439/607.05

* cited by examiner

CROSSTALK-PROOF RECEPTACLE CONNECTOR

BACKGROUND OF THE INVENTION

1. Field of the Invention

The present invention relates to a connector, and more particularly to a crosstalk-proof receptacle connector that is able to suppress crosstalk between signal terminals.

2. Description of Related Art

Servers such as blade servers and rack mount servers have printed circuit boards (PCBs) mounted with connectors for high speed and stable signal transmission. Such high speed connectors have compactly arranged terminals for massive signal transmission. However, crosstalk usually occurs between adjacent terminals and becomes worse when the signal terminals are operated to transmit high frequency signals, which lowers the efficiency of signal transmission and even causes failure of signal transmission.

With reference to FIG. 12, to prevent the aforementioned crosstalk, an improved connector has been developed. The connector has multiple insulative boards 90, multiple metal shielding plates 92 and a casing 93. The insulative boards 90 are arranged abreast and each insulative board 90 has a set of multiple terminals 91 mounted thereon. The metal shielding plates 92 are mounted respectively on the insulative boards 90 and are arranged alternately with the insulative boards 90 so that each metal shielding plate 92 is between two adjacent sets of the terminals 91. The casing 93 covers the insulative boards 90. The aforementioned arrangement of the connector is able to prevent the signal interference between adjacent sets of the terminals 91 on two opposite sides of one metal shielding plate 92. However, the metal shielding plate 92 is a single piece with sufficient width and length and therefore provides a sufficient long and diagonal path $P_0$ to allow electric charges to run thereon, which causes antenna effect and additional signal interference. For example, the diagonal path $P_0$ on the metal shielding plate 92 is the longest path and easily causes antenna effect.

If the diagonal path on the metal shielding plate 92 can be interrupted, the antenna effect will be reduced. However, no means are implemented to the connector to cut the path of antenna effect. The following prior art disclose some improvements to connectors. However, these improvements are not to cut the path of antenna effect and therefore cannot efficiently reduce the antenna effect.

U.S. Pat. No. 7,347,740 discloses a lead frame assembly for a connector having mounting holes on terminals. Dielectric material is filled in the mounting holes and partially covers the terminal. However, the connector has no any shielding element to prevent crosstalk.

U.S. Pat. No. 7,074,086 mentions another prior art U.S. Pat. No. 6,409,543 that discloses a shielding plate with multiple through holes. The through holes allow a tool to extend through the through holes during fabrication to cut fixing bars between adjacent terminals. However, no crosstalk-proof elements are made.

U.S. Pat. No. 8,182,289 discloses a connector with a lossy insert. The lossy insert has multiple holes to be engaged with pins on a wafer. No crosstalk-proof elements are disclosed in the patent.

To overcome the shortcomings, the present invention provides a crosstalk-proof receptacle connector to mitigate or obviate the aforementioned problems.

SUMMARY OF THE INVENTION

The main objective of the invention is to provide a receptacle connector that is able to suppress crosstalk between signal terminals.

A crosstalk-proof receptacle connector in accordance with the present invention comprises: multiple insulative boards arranged abreast; multiple sets of terminals mounted respectively in and corresponding to the insulative boards, and each set including signal terminals and grounding terminals; multiple shielding plates corresponding to the insulative boards and corresponding to the sets of the terminals, each shielding plate mounted on one of two opposite sides of a corresponding insulative board and having multiple current-path-interrupting holes defined through the shielding plate and kept hollow without being inserted by objects, and each shielding plate connected to the grounding terminals of a corresponding set of the terminals; and an outer casing covering the insulative boards to combine the insulative boards. The crosstalk-proof receptacle connector suppresses crosstalk and improves efficiency and stability of signal transmission.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
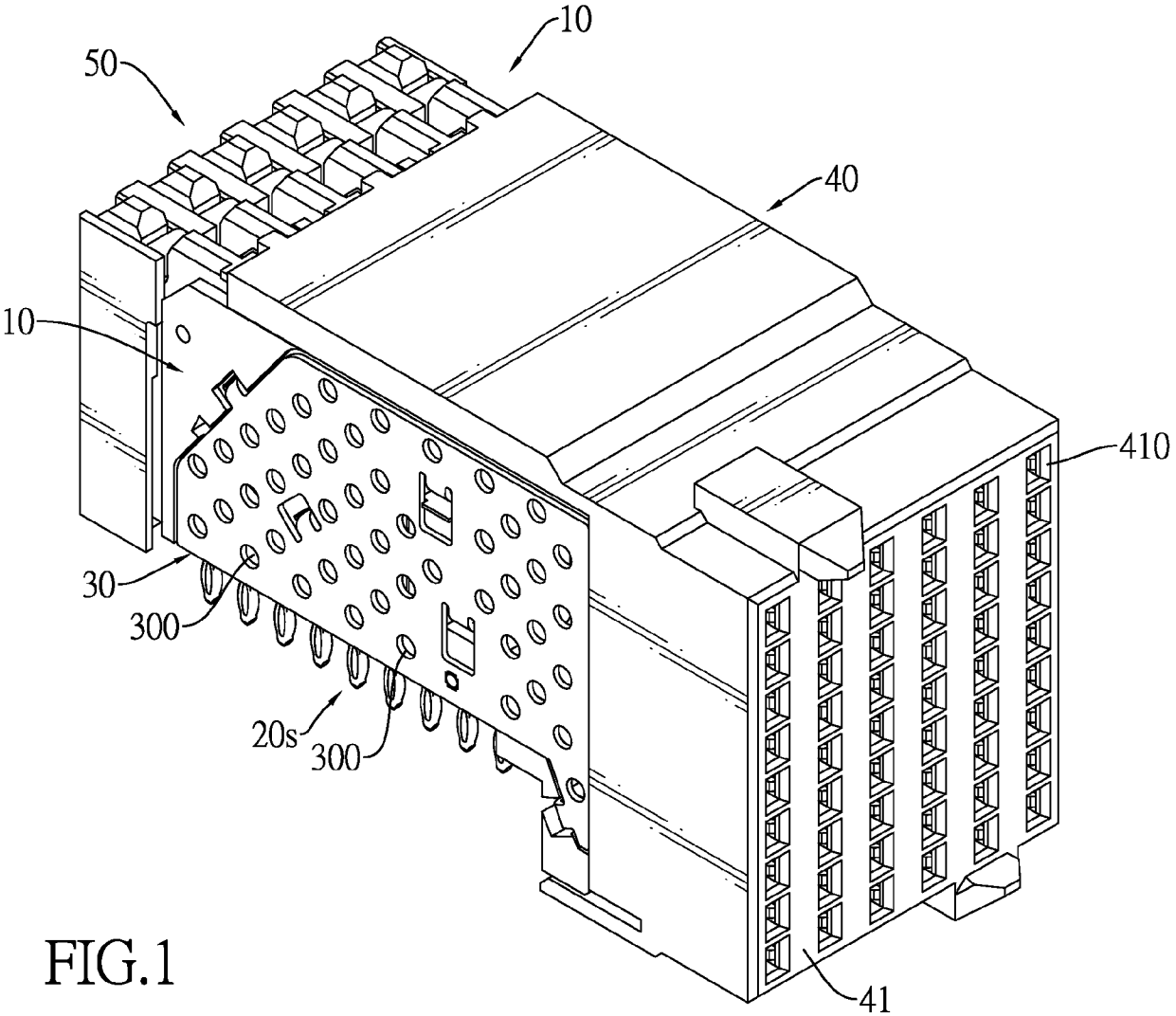
FIG. 1 is a perspective view of a crosstalk-proof receptacle connector in accordance with the present invention.
Figure 2:
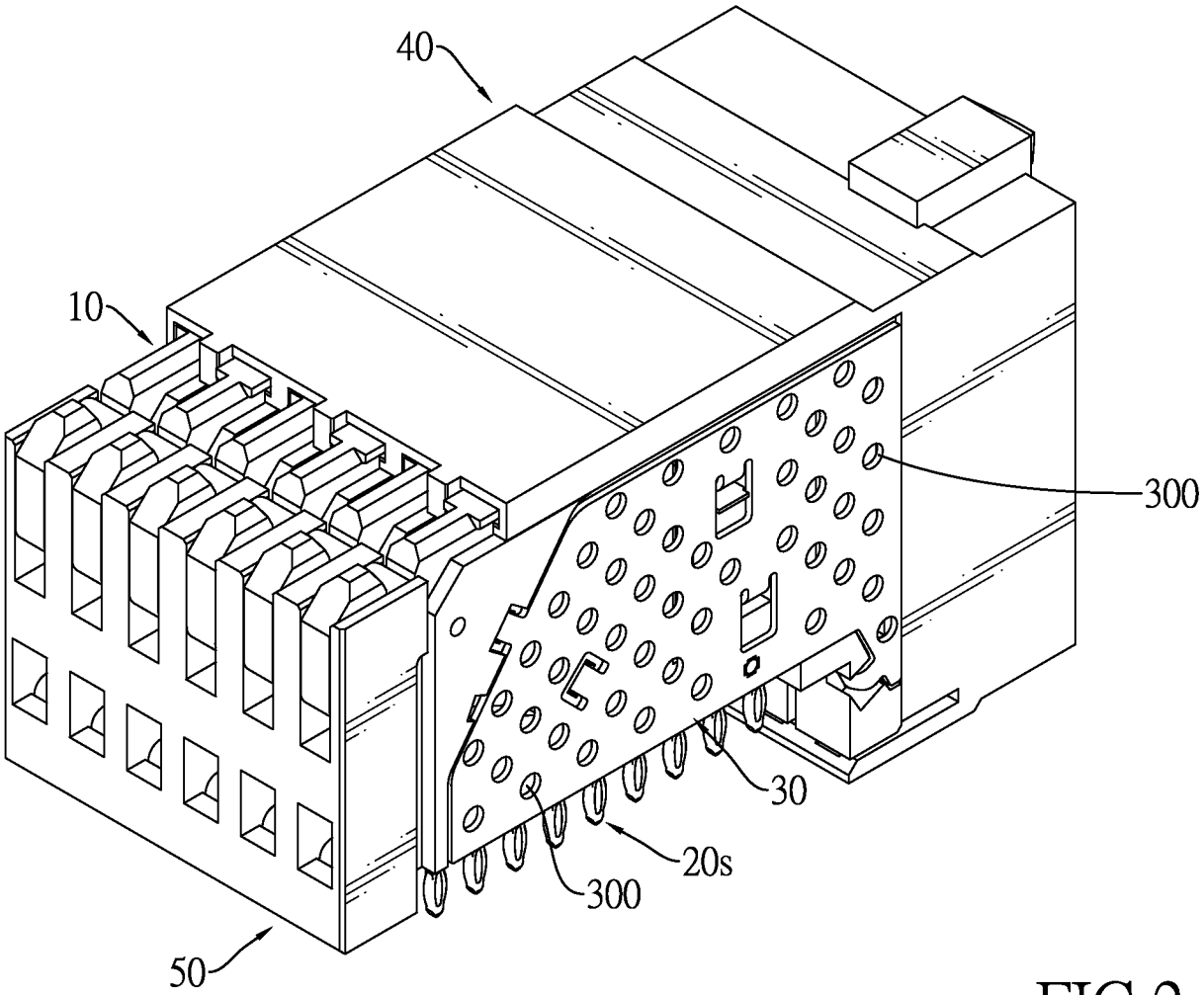
FIG. 2 is another perspective view of the crosstalk-proof receptacle connector in FIG. 1.
Figure 3:
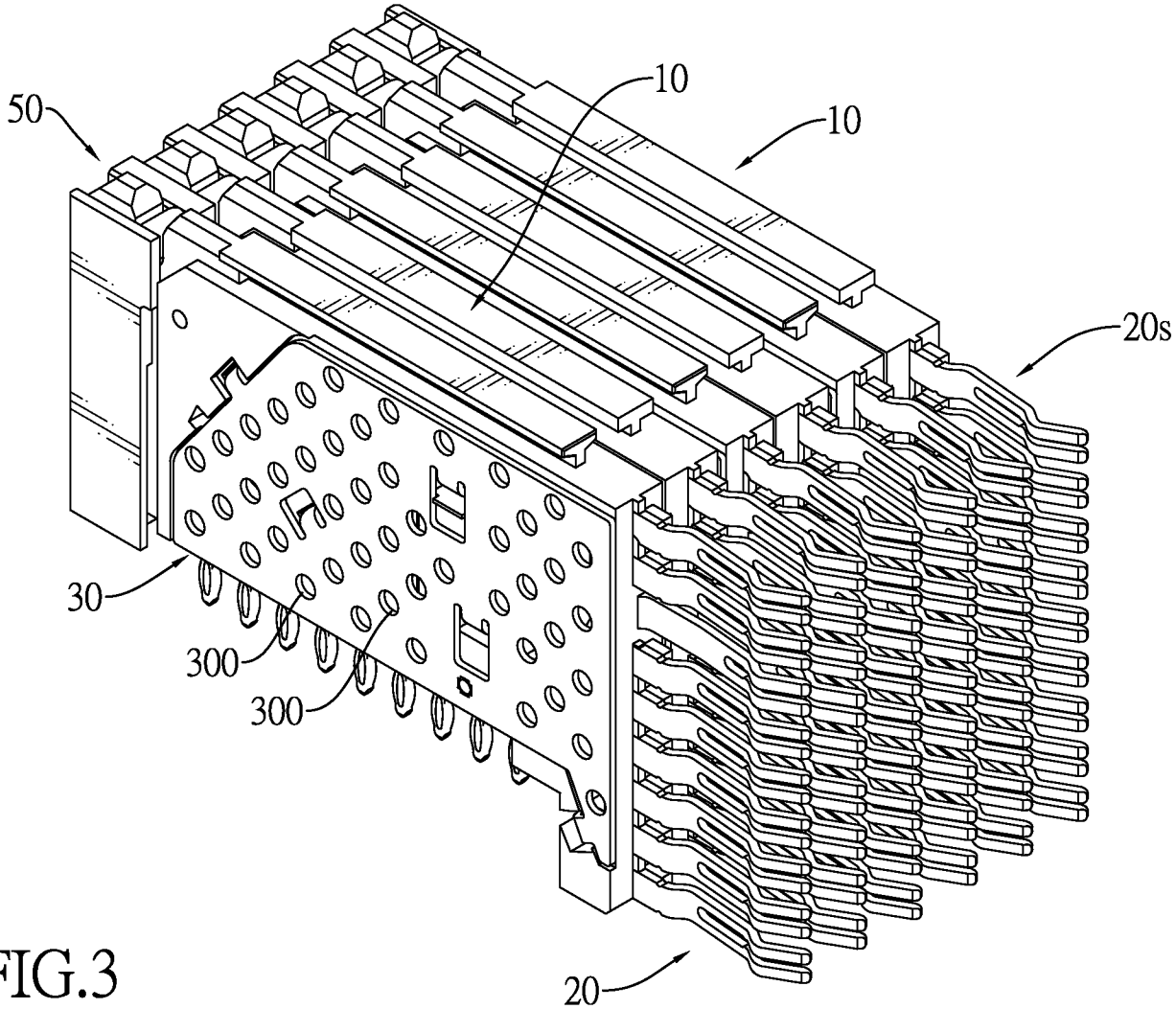
FIG. 3 is a perspective view of the crosstalk-proof receptacle connector in FIG. 2 with the outer casing omitted.

With reference to FIGS. 1 to 3, a crosstalk-proof receptacle connector in accordance with the present invention may be soldered on a PCB and comprises multiple insulative boards 10, multiple sets of terminals 20*s*, 20*g*, multiple shielding plates 30, an outer casing 40 and a rear assembling cover 50.

Figure 4:
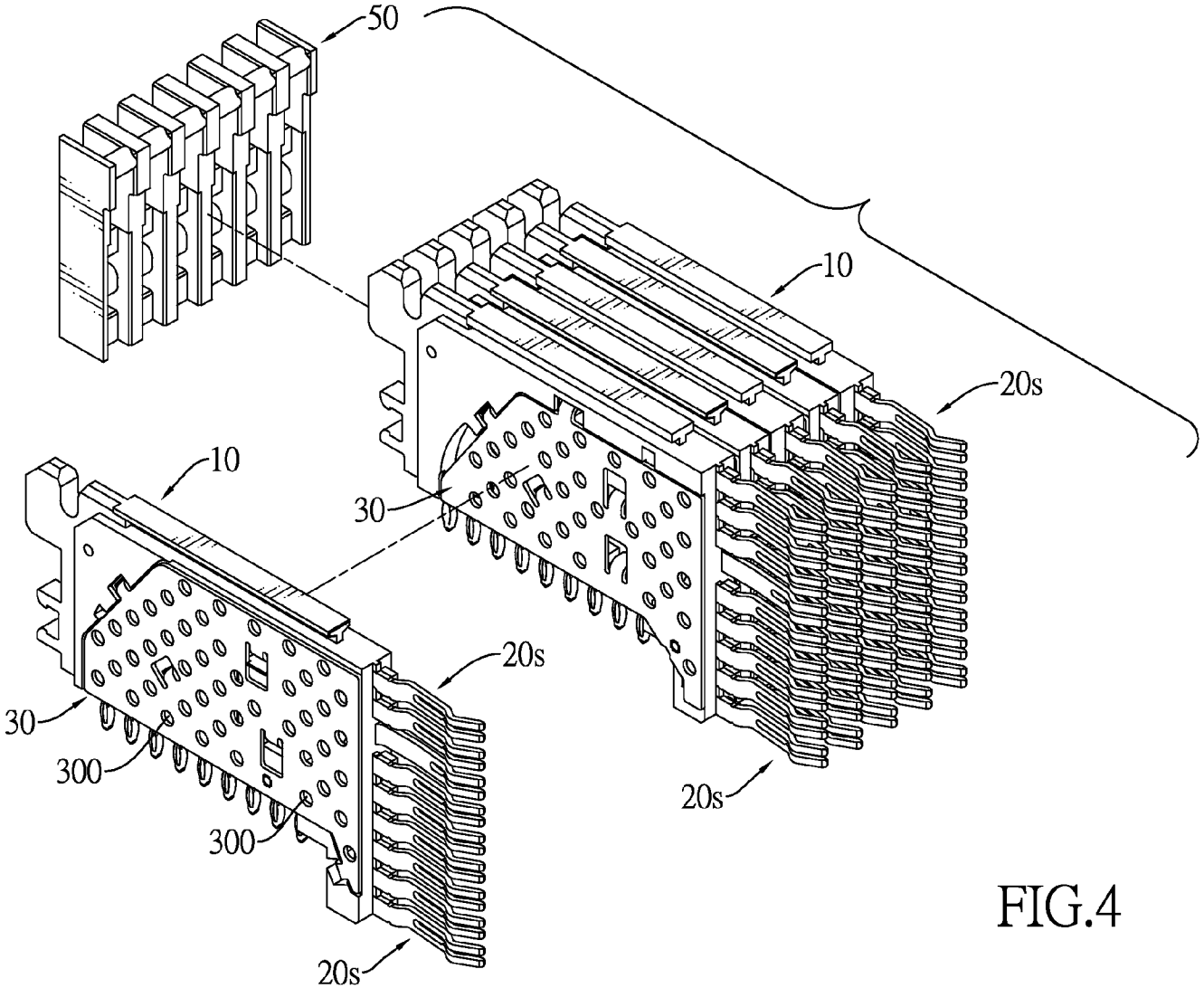
FIG. 4 is an exploded perspective view of the crosstalk-proof receptacle connector in FIG. 3.
Figure 5:
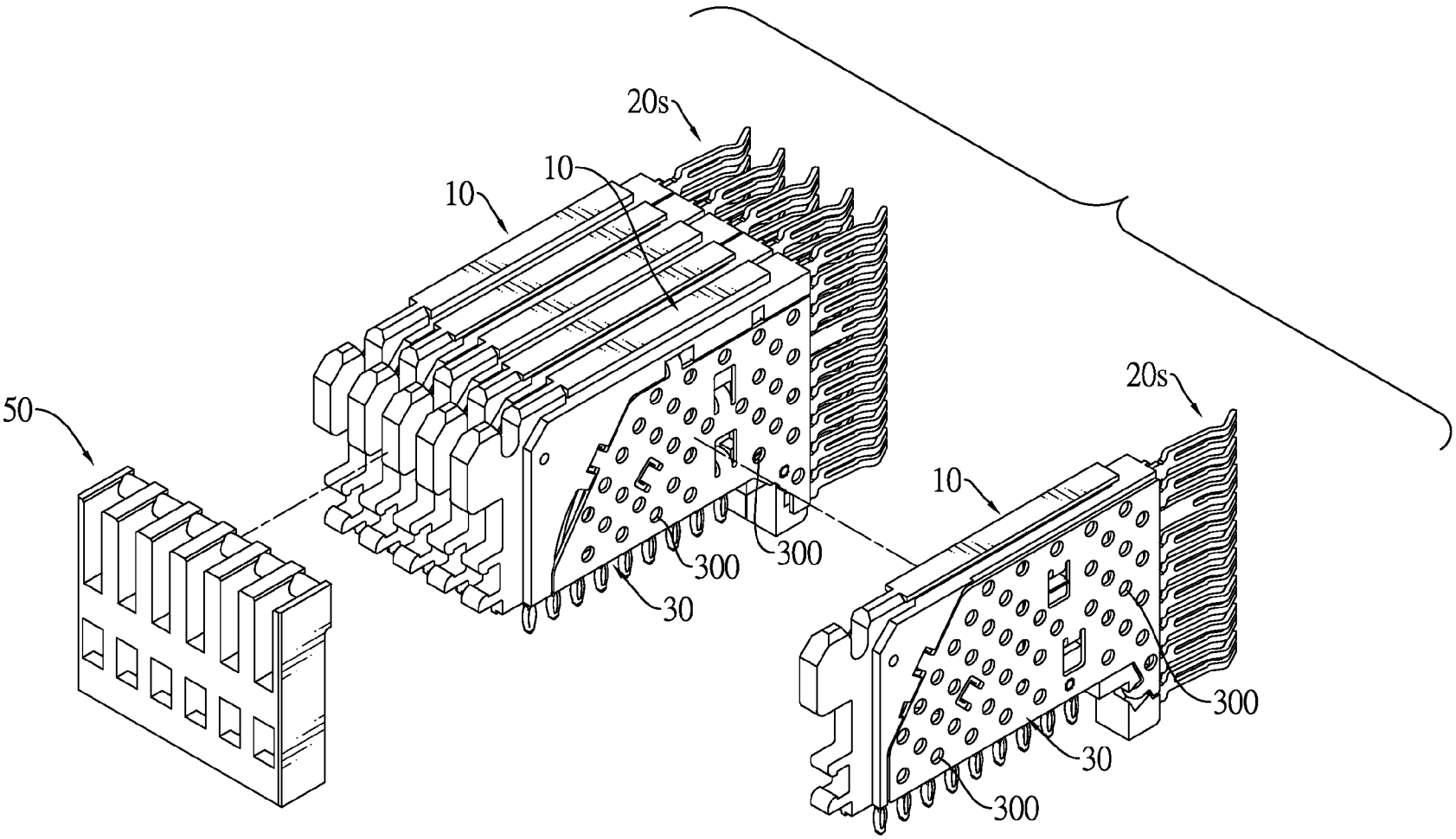
FIG. 5 is another exploded perspective view of the crosstalk-proof receptacle connector in FIG. 3.
Figure 6:
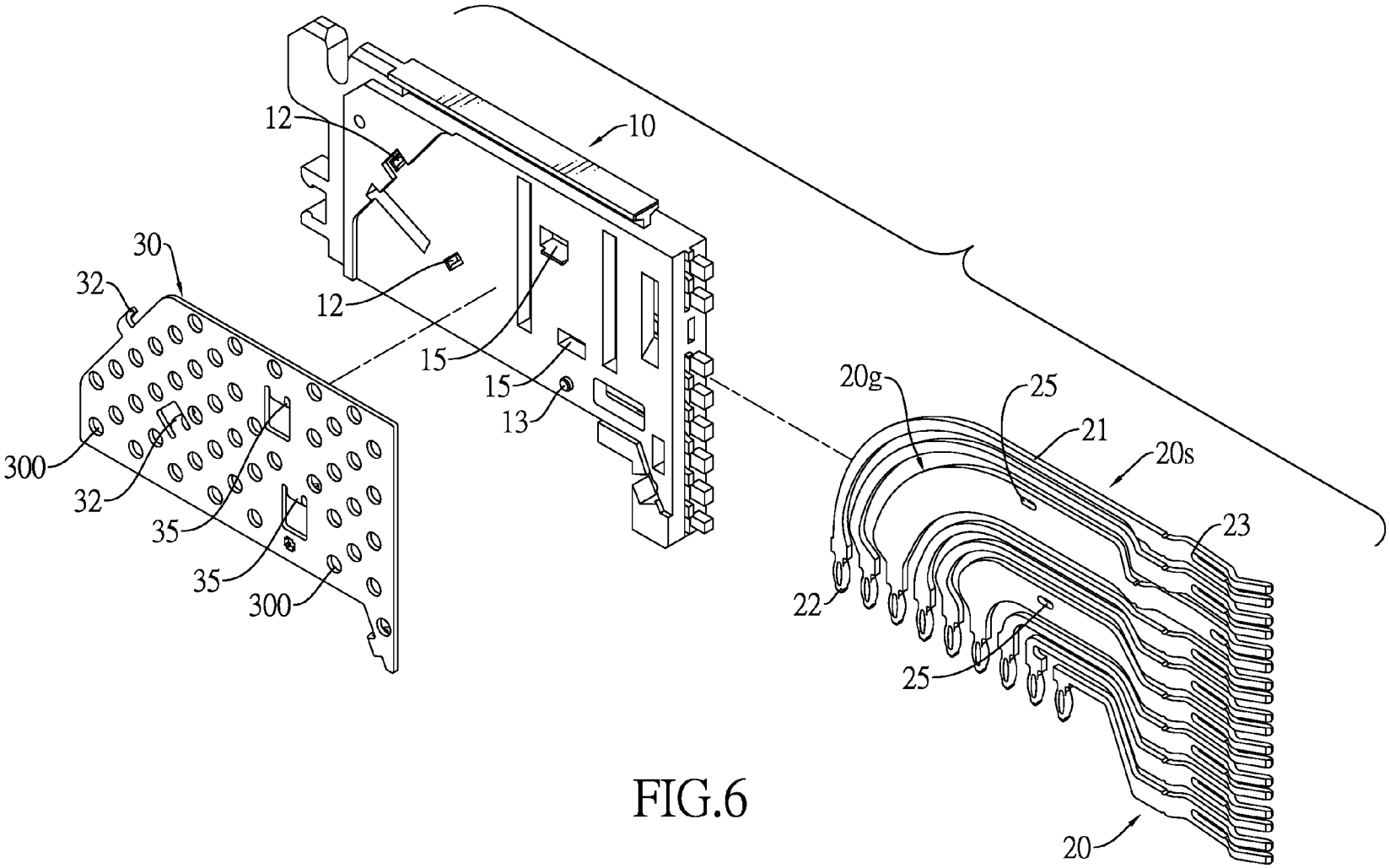
FIG. 6 is an exploded perspective view of an insulative board, a set of terminals and a set of shielding plates of the crosstalk-proof receptacle connector in FIG. 3.

With reference to FIGS. 4 to 6, the insulative boards 10 are arranged abreast and each insulative board 10 has multiple first engaging elements 12, 13.

The first engaging elements 12, 13 are formed on the insulative board 10.

The sets of the terminals 20*s*, 20*g* are mounted respectively in and correspond to the insulative boards 10 and each set includes signal terminals 20*s* and grounding terminals 20*g*.

Each signal or grounding terminal 20*s*, 20*g* has a mounting section 21, an assembling section 22 and an electrical contacting section 23.

The mounting section 21 is embedded in a corresponding insulative board 10.

The assembling section 22 is formed on and protrudes downward from the mounting section 21 and may be soldered or press-fitted on the PCB.

The electrical contacting section 23 may be forked and is formed on and protrudes forward from the mounting section 21 to electrically contact a terminal of a plug connector corresponding to the crosstalk-proof receptacle connector.

Figure 7:
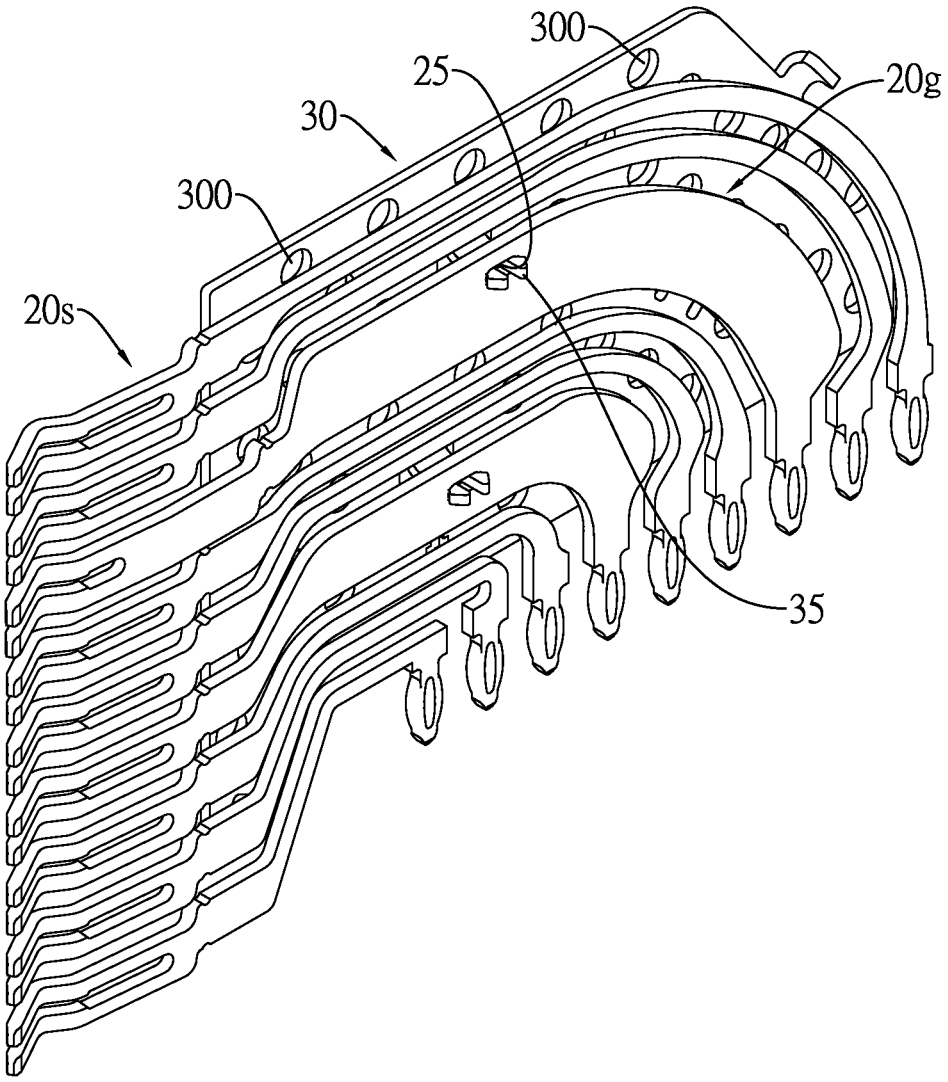
FIG. 7 is a perspective view of the terminals of the crosstalk-proof receptacle connector in FIG. 6.
Figure 8:
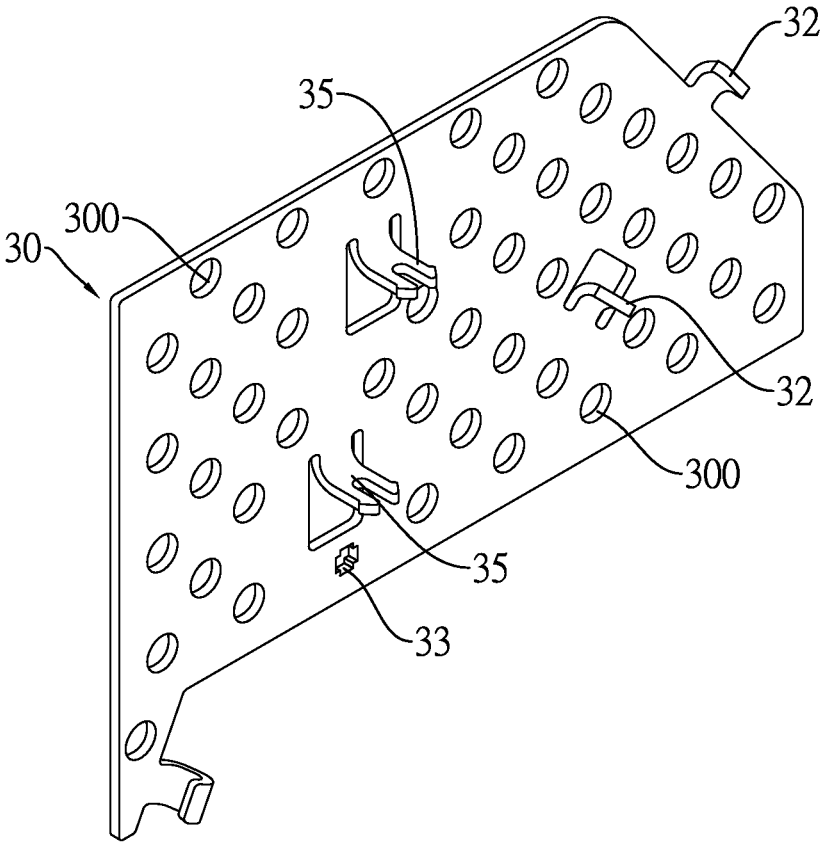
FIG. 8 is a perspective view of the shielding plate of the crosstalk-proof receptacle connector in FIG. 6.
Figure 9:
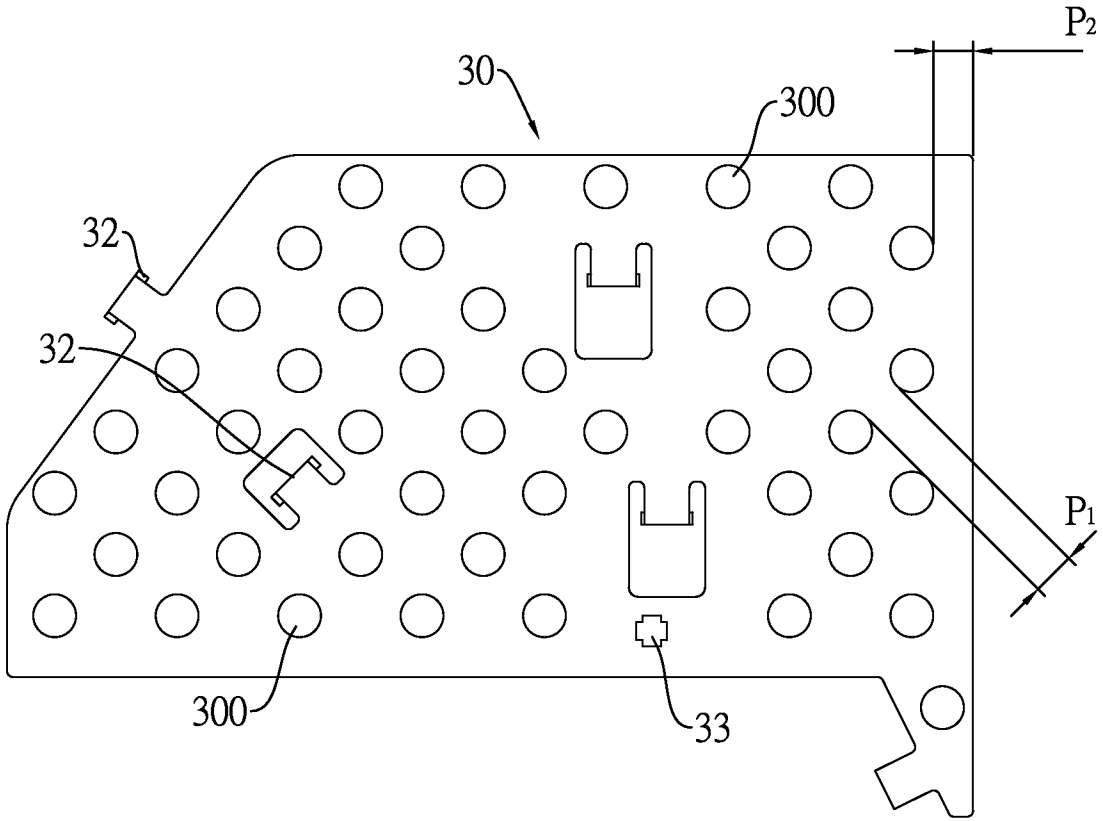
FIG. 9 is a side view of the shielding plate of the crosstalk-proof receptacle connector in FIG. 6.

With further reference to FIGS. 7 to 9, the shielding plates 30 are used for preventing crosstalk between adjacent sets of the terminals 20*s*, 20*g*, correspond to the insulative boards 10 and correspond to the sets of the terminals 20*s*, 20*g*. Each shielding plate 30 is mounted on one side of a corresponding insulative board 10 and has multiple current-path-interrupting holes 300. The current-path-interrupting holes 300 are defined through the shielding plate 30 and kept hollow without being inserted by objects. Furthermore, each shielding plate 30 is connected to the grounding terminals 20*g* of a corresponding set of the terminals 20*s*, 20*g*.

According to antenna effect, an exposed metal piece easily possesses antenna characteristics, collects electric charges to increase electric potential, and then generates current. The current easily runs along a sufficiently long path on the metal piece to cause high or low frequency signal interference. Therefore, forming the current-path-interrupting holes 300 on each shielding plate 30 cuts the longest current path along a diagonal line on the shielding plate 30 into much shorter paths between adjacent current-path-interrupting holes 300, which reduces and even prevents current paths and effectively reduce the antenna effect on each shielding plate 30. As shown in FIG. 9, a path $P_1$ between adjacent current-path-interrupting holes 300 are shorter than 0.9 mm, which is much shorter than the diagonal line of the shielding plate 30. A path $P_2$ between an edge of the shielding plate 300 and a nearest current-path-interrupting hole $P_3$ is shorter than 1 mm. Therefore, the shielding plates 30 effectively decrease antenna effect.

Furthermore, each shielding plate 30 of each set has at least one second engaging element 32, 33 that is engaged with the at least one of the first engaging elements 12, 13 of the corresponding insulative board 10.

The outer casing 40 covers the insulative boards 10 to combine the insulative boards 10 and has multiple socket holes 410. The socket holes 410 are defined in a front 41 of the outer casing 40 and respectively receive the electrical contacting sections 23 of the terminals 20*s*, 20*g*.

The rear assembling cover 50 is mounted on rear ends of the insulative boards 10 to ensure that the insulative boards 10 are combined and arranged abreast precisely.

In a preferred embodiment, each first engaging element 12, 13 is a recess or a protrusion, and each second engaging element 32, 33 is a protrusion or a recess corresponding to the recess or protrusion that is the first engaging element 12, 13.

In a preferred embodiment, each shielding plate 30 has a first connecting element 35 formed thereon. The first connecting element 35 may be a hooking tab. Each grounding terminal 20*g* has a second connecting element 25 formed thereon and connected to the first connecting element 35 on the shielding plate 30 that is connected to the grounding terminal. The second connecting element 25 may be a hooking hole hooked by the hooking tab. Furthermore, each insulative board 10 has multiple through holes 15 through which the first connecting element 35 extends.

Figure 10:
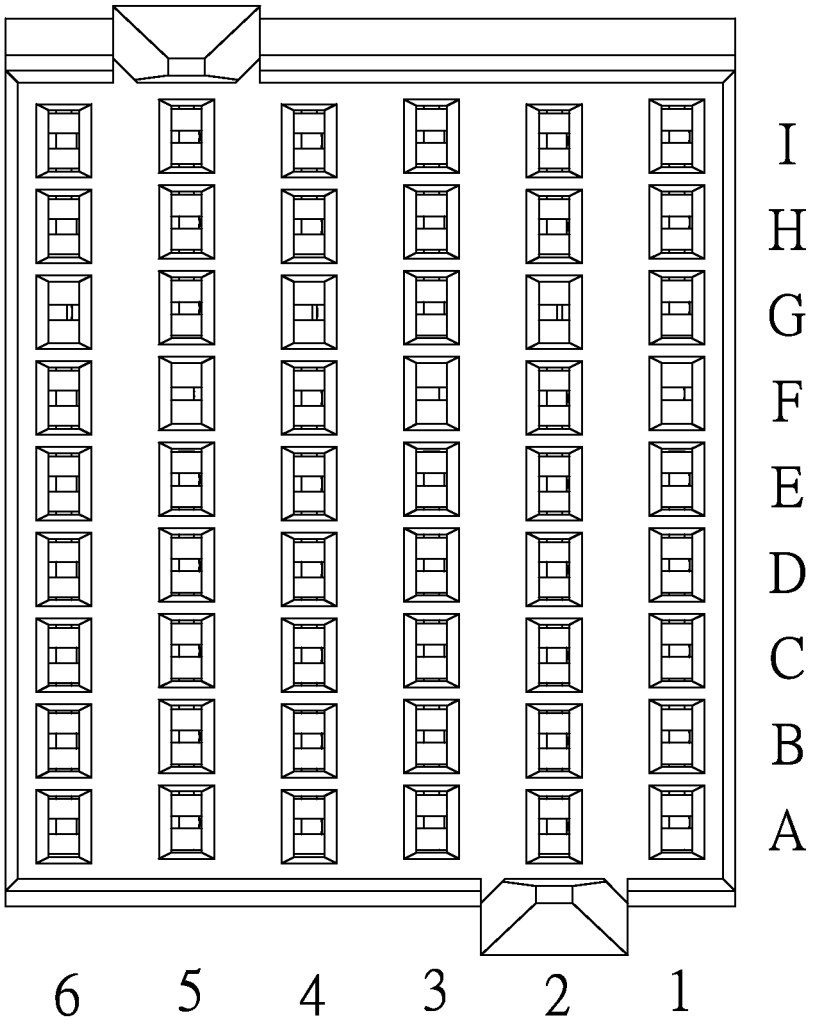
FIG. 10 is a front view of the crosstalk-proof receptacle connector in FIG. 10.

With further reference to FIG. 10, a signal test is implemented. According to the front view of the socket holes 410, the terminals 20 are arranged into an array with A to I rows and 1 to 6 columns. Crosstalk tests respectively between adjacent terminals 20 are implemented, for example, a crosstalk test of two terminals 20 located respectively on coordinates (A, 3) and (B, 3) (the two coordinates are abbreviated to AB3 and similar abbreviations will be done hereafter). The following comparison tables are for the receptacle connector of the present invention with the shielding plates 30 and a conventional receptacle connector without shielding plates.

TABLE 1

Proximal end crosstalk of signal terminal pairs: Raising time: 55 ps(20-80%) measurement of peak to peak variation employed

| Coordinates of signal terminals (adjacent signal terminals) | Proximal end crosstalk without shielding plates (%) | Proximal end crosstalk with shielding plates(%) | Difference value |
|---|---|---|---|
| AB3 | 1.48% | 1.04% | 0.38% |
| DE3 | 2.63% | 2.32% | 0.23% |
| GH3 | 1.83% | 1.78% | 0.13% |
| BC2 | 2.05% | 1.88% | 0.15% |
| EF2 | 2.92% | 2.24% | 0.52% |
| HI2 | 0.87% | 0.86% | 0.01% |

TABLE 2

Distal end crosstalk of signal terminal pairs: Raising time: 55 ps(20-80%) measurement of peak to peak variation employed

| Coordinates of signal terminals (adjacent signal terminals) | Distal end crosstalk without shielding plates (%) | Distal end crosstalk with shielding plates(%) | Difference value |
|---|---|---|---|
| AB3 | 1.08% | 0.98% | 0.10% |
| DE3 | 1.52% | 1.30% | 0.22% |
| GH3 | 0.96% | 1.30% | −0.34% |
| BC2 | 1.15% | 1.20% | −0.05% |
| EF2 | 1.72% | 1.16% | 0.56% |
| HI2 | 0.86% | 0.96% | −0.10% |

According to the aforementioned comparison tables, the crosstalk of most of the terminals 20*s*, 20*g* are lowered after using the shielding plates 30 so that the signal transmission efficiency and stability are improved.

Figure 11:
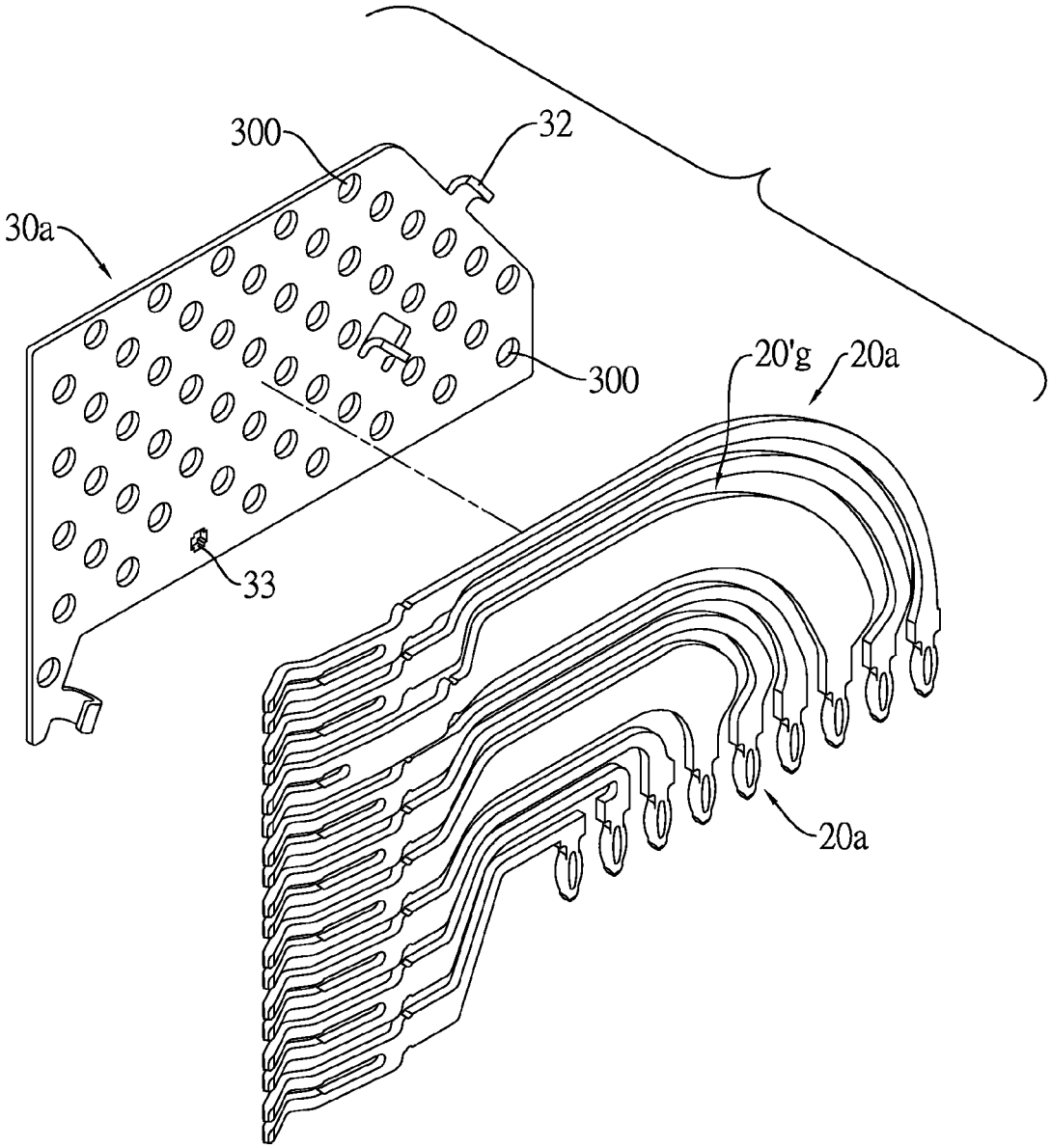
FIG. 11 is a perspective view of a set of terminals and a shielding plate of another embodiment of a crosstalk-proof receptacle connector in accordance with the present invention.
Figure 12:
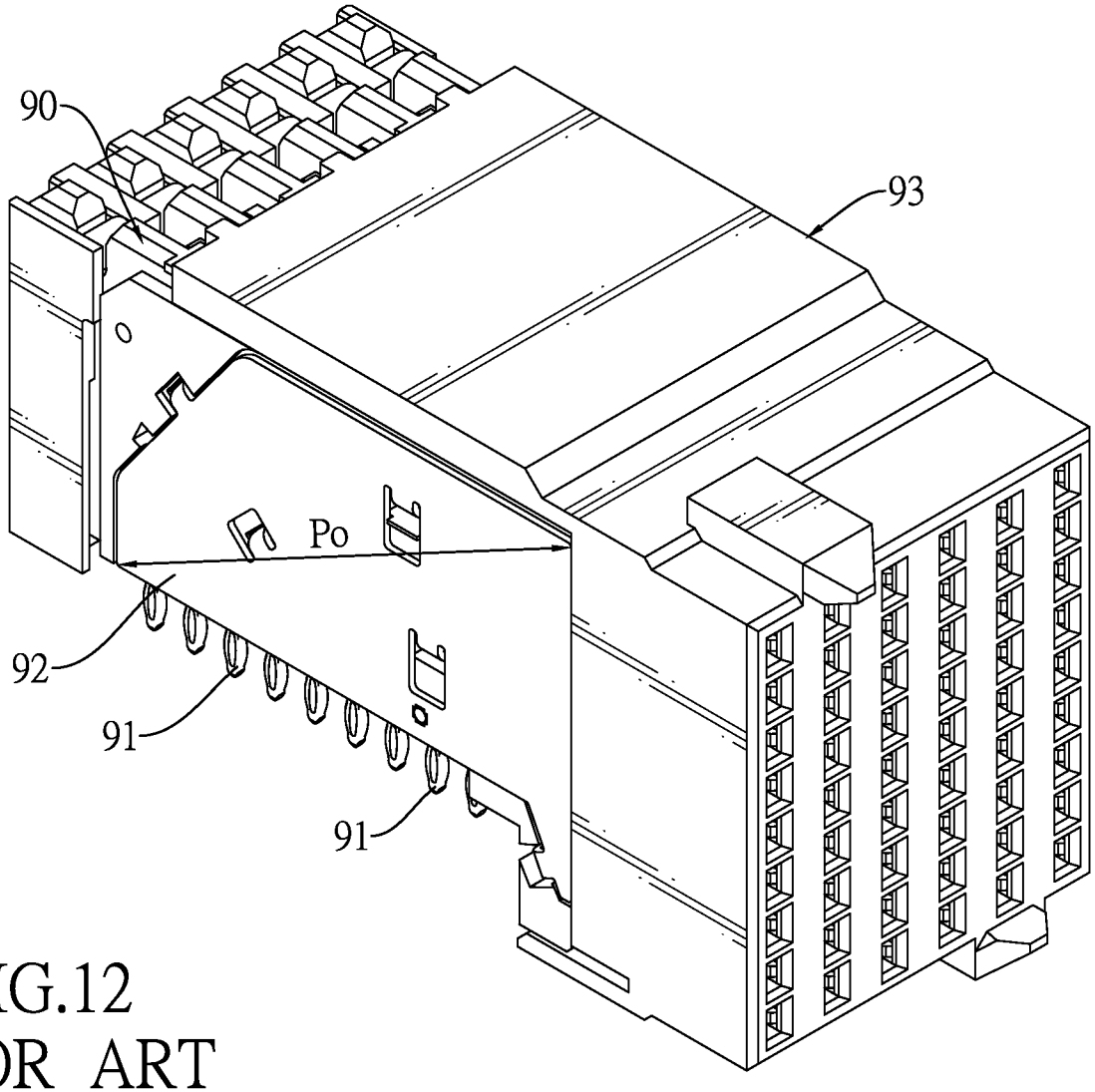
FIG.12 PRIOR ART
FIG. 12 is a perspective view of a conventional connector in accordance with the prior art.

With further reference FIG. 11, another embodiment of the crosstalk-proof receptacle connector of the present invention has each shielding plate 30*a* unconnected to any one of the signal terminals 20*s* or grounding terminals 20'*g*. Therefore, each shielding plate 30*a* does not have any first connecting elements and each signal terminal 20*s* or grounding terminal 20'*g* does not have any second connecting element. However each shielding plate 30*a* still has the second engaging element 32, 33 for engaging the first engaging element 12, 13 of the insulative board 10.

According to the aforementioned description, the present invention has the following advantages.

1. Because each insulative board 10 is mounted with a shielding plate 30 on one side to alternately arrange the insulative boards 10 and the shielding plates 30, crosstalk between adjacent sets of terminals 20 is decreased.

2. The shielding plate 30 has multiple current-path-interrupting holes 300 to reduce and even prevent antenna effect on the shielding plate 30, which extremely suppresses crosstalk and improves efficiency and stability of signal transmission.

3. The first connecting element 35 of the shielding plate 30 is connected to the second connecting element 25 of the grounding terminal 20*g* so that the grounding effect is extended to direct the static electricity and signal noise likely causing crosstalk out of the receptacle connector to further improve signal transmission efficiency and stability.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crosstalk-proof receptacle connector comprising:

multiple insulative boards arranged abreast;

multiple sets of terminals mounted respectively in and corresponding to the insulative boards, and each set including signal terminals and grounding terminals;

multiple shielding plates corresponding to the insulative boards and corresponding to the sets of the terminals, each shielding plate mounted on one of two opposite sides of a corresponding insulative board and having multiple current-path-interrupting holes defined through the shielding plate and kept hollow without being inserted by objects after being mounted to the corresponding insulative board, and each shielding plate connected to the grounding terminals of a corresponding set of the terminals; and an outer casing covering the insulative boards to combine the insulative boards.

2. The crosstalk-proof receptacle connector as claimed in claim 1, wherein each insulative board has multiple first engaging elements formed on the insulative board; and each shielding plate has at least one second engaging element engaged with the at least one of the first engaging elements of a corresponding insulative board.

3. The crosstalk-proof receptacle connector as claimed in claim 2, wherein each first engaging element is a recess or protrusion; and each second engaging element is a protrusion or recess corresponding to the recess or protrusion that is the first engaging element.

4. The crosstalk-proof receptacle connector as claimed in claim 3, wherein each shielding plate has a first connecting element formed thereon;

each grounding terminal of a corresponding set of the terminals has a second connecting element formed thereon and connected to the first connecting element on the shielding plate that is connected to the grounding terminal; and each insulative board has multiple through holes through which the first connecting element extends.

5. The crosstalk-proof receptacle connector as claimed in claim 4, wherein the first connecting element is a hooking tab; and the second connecting element is a hooking hole hooked by the hooking tab.

6. The crosstalk-proof receptacle connector as claimed in claim 5 further comprising a rear assembling cover mounted on rear ends of the insulative boards.

7. The crosstalk-proof receptacle connector as claimed in claim 6, wherein each terminal of each set has a mounting section embedded in the corresponding insulative board;

an assembling section formed on and protruding downward from the mounting section; and an electrical contacting section formed on and protruding forward from the mounting section.

8. The crosstalk-proof receptacle connector as claimed in claim 7, wherein each shielding plate is made of metal.

9. The crosstalk-proof receptacle connector as claimed in claim 8, wherein a path between adjacent current-path-interrupting holes are shorter than 0.8 mm.

10. The crosstalk-proof receptacle connector as claimed in claim 8, wherein a path between an edge of the shielding plate and a nearest current-path-interrupting hole is shorter than 1 mm.

11. A crosstalk-proof receptacle connector comprising:

multiple insulative boards arranged abreast; multiple sets of terminals mounted respectively in and corresponding to the insulative boards, and each set including signal terminals and grounding terminals;

multiple shielding plates corresponding to the insulative boards and corresponding to the sets of the terminals, each shielding plate mounted on one of two opposite sides of a corresponding insulative board and having multiple current-path-interrupting holes defined through the shielding plate and kept hollow without being inserted by objects after being mounted to the corresponding insulative board; and an outer casing covering the insulative boards to combine the insulative boards.

12. The crosstalk-proof receptacle connector as claimed in claim 1, the shielding plates and the sets of terminals are located respectively in different planes without overlapping one another.

13. The crosstalk-proof receptacle connector as claimed in claim 1, wherein each shielding plate is made of metal.

14. The crosstalk-proof receptacle connector as claimed in claim 11, the shielding plates and the sets of terminals are located respectively in different planes without overlapping one another.

15. The crosstalk-proof receptacle connector as claimed in claim 11, wherein each shielding plate is made of metal.

16. The crosstalk-proof receptacle connector as claimed in claim 11, wherein the shielding plates are not electrically connected to any one of the signal terminals or grounding terminals.

* * * * *